US008138137B2

(12) United States Patent
Leclerc et al.

(10) Patent No.: US 8,138,137 B2
(45) Date of Patent: Mar. 20, 2012

(54) EXTENDED DELIVERY OF INGREDIENTS FROM A FABRIC SOFTENER COMPOSITION

(75) Inventors: Stephane Leclerc, Middlewich (GB); Ralph Spindler, Palatine, IL (US); Stephen J. Urbanec, Arlington Heights, IL (US); Alan McClellan, Cheshire (GB); Melanie Jane Hughes, Cheshire (GB)

(73) Assignee: AMCOL International Corporation, Hoffman Estates, IL (US)

( * ) Notice: Subject to any disclaimer, the term of this patent is extended or adjusted under 35 U.S.C. 154(b) by 587 days.

(21) Appl. No.: 11/813,789

(22) PCT Filed: Feb. 2, 2006

(86) PCT No.: PCT/US2006/003723

§ 371 (c)(1), (2), (4) Date: May 14, 2009

(87) PCT Pub. No.: WO2006/084060

PCT Pub. Date: Aug. 10, 2006

(65) Prior Publication Data

US 2010/0009894 A1 Jan. 14, 2010

Related U.S. Application Data

(60) Provisional application No. 60/650,443, filed on Feb. 4, 2005.

(51) Int. Cl.
*C11D 17/00* (2006.01)
*C11D 3/50* (2006.01)

(52) U.S. Cl. ..... 510/515; 512/4

(58) Field of Classification Search ..... 510/515; 512/4
See application file for complete search history.

(56) References Cited

U.S. PATENT DOCUMENTS 4,962,133 A * 10/1990 Chromecek et al. ..... 521/56
6,024,943 A 2/2000 Ness et al.

FOREIGN PATENT DOCUMENTS

| | | |
|---|---|---|
| EP | 0 397 245 | 11/1990 |
| EP | 1 061 124 | 12/2000 |
| WO | WO-00/68352 | 11/2000 |
| WO | WO-02/38713 | 5/2002 |
| WO | WO-03/054130 | 7/2003 |

OTHER PUBLICATIONS

International Search Report in PCT/US2006/003723 dated May 16, 2006.

* cited by examiner

*Primary Examiner* — John Hardee
(74) *Attorney, Agent, or Firm* — Marshall, Gerstein & Borun LLP

(57) ABSTRACT

A controlled delivery system for active ingredients, like a fragrance, for use in fabric softener products, such as tumble dryer sheets, rinse added liquids, and similar products, is disclosed. The delivery system enhances performance of an active ingredient, such as a fragrance. The controlled delivery system contains polymeric micro-particles highly loaded with the active ingredient. Other active ingredients that can be incorporated into a fabric softener composition using the delivery system include ironing aides, silicone fluids, anti-wrinkle agents, antistatic agents, optical brighteners, fabric crisping agents, bleaching agents, germicides, fungicides, flow agents, and surfactants.

22 Claims, No Drawings

EXTENDED DELIVERY OF INGREDIENTS FROM A FABRIC SOFTENER COMPOSITION

CROSS-REFERENCE TO RELATED APPLICATIONS

This is the U.S. national phase application of International Application No. PCT/US2006/03723, filed Feb. 2, 2006, which claims the benefit of U.S. provisional application No. 60/650,443, filed Feb. 4, 2005.

FIELD OF THE INVENTION

The present invention relates to an improved controlled release delivery system for an active ingredient incorporated into fabric softener compositions. The delivery system enhances deposition of active ingredients, like fragrances, softening agents, and optical brighteners, from the fabric softener onto a fabric, and provides a sustained release of the active ingredient from the treated fabric over an extended period of time and a surge release of the active ingredient when the treated fabric is ironed.

BACKGROUND OF THE INVENTION

The consumer products industry has long searched for ways to enhance the performance of fabric care products, like a fabric softener, and to make the products more esthetically pleasing to consumers. For example, fragrance is an important ingredient in successful commercial fabric care products because, in addition to imparting an esthetically pleasing odor, a fragrance conveys a positive image of product performance to the consumer, e.g., the fabric is clean and fresh.

Fragrances typically are added to fabric care products to provide a fresh, clean impression for the product itself, as well as to the fabric treated with the product. Although the fragrance does not enhance the performance of a fabric care product, the fragrance makes these products more esthetically pleasing, and consumers expect and demand a pleasing odor for such products.

A fragrance plays an important, and often a determining, role when the consumer selects and purchases a fabric care product. Many consumers desire the fragrance to be deposited on the fabric and remain on the fabric for an extended time in order to convey a continuing impression of freshness. Consumers also desire fabric care products that impart a sufficient fragrance level to the fabric, and, in some embodiments, release the fragrance when the fabric is ironed.

Introduction of a fragrance into a fabric care product is restricted by considerations such as availability and cost, and also by an inability of the fragrance to sufficiently deposit onto a fabric, and then remain on the fabric during the wash, rinse, and drying cycles. For example, a substantial amount of the fragrance deposited on a fabric is removed from the fabric during the drying process, even when the treated fabrics are line dried. It also has been demonstrated that a substantial amount of the fragrance in currently available fabric care products is lost during rinse cycles. This fragrance loss is attributed to the water solubility of various fragrance ingredients, and to the volatility of fragrance ingredients that deposit on the fabric.

Typical fabric care products, such as laundry detergent compositions and fabric softener compositions, contain about 0.1% to about 1%, by weight, of a fragrance. U.S. Pat. No. 6,051,540 discloses that in the course of the washing clothes with a standard powdered laundry detergent, or a fabric softener rinse, only a small fraction of the fragrance present in these fabric care products is actually transferred to the fabric, i.e., as low as 1% of the original amount of fragrance present in these products.

Attempts have been made to increase fragrance deposition onto fabric, and to hinder or delay the release of the fragrance from the fabric, such that the laundered fabric remains esthetically pleasing for an extended length of time. One approach uses a carrier to introduce the fragrance to the fabric. The carrier is formulated to contain a fragrance and to adhere to the fabric during a washing cycle through particle entrainment or chemical change.

Fragrances have been adsorbed onto various materials, such as silica and clay, for delivery of the fragrance from detergents and fabric softeners to fabrics. U.S. Pat. No. 4,954,285 discloses fragrance particles especially for use with dryer-released fabric softening/antistatic agents. The fragrance particles are formed by adsorbing the fragrance onto silica particles having a diameter of greater than about one micron. The fragrance particles are included in dryer-activated solid fabric softener compositions including coated particles of fabric softener. The compositions release softener to fabrics in the dryer, and the fragrance particles improve the esthetic character of the fabric softener deposited on the fabric. The fragrance particles also can be admixed with detergent granules and can be coated or uncoated. This system has a drawback in that the fragrance is not sufficiently protected, and frequently is lost or destabilized during processing.

Another problem often associated with perfumed fabric care products is excessive odor intensity. A need therefore exists for a fragrance delivery system that provides satisfactory fragrance both during use and from the dry laundered fabric, and also provides prolonged storage benefits and an acceptable odor intensity of the fabric care product.

U.S. Pat. No. 6,790,814 discloses that a fragrance loaded into a porous carrier, such as zeolite particles, can be effectively protected from premature release of the fragrance by coating the loaded carrier particles with a hydrophobic oil, then encapsulating the resulting carrier particles with a water-soluble or water-dispersible, but oil-insoluble, material, such as a starch or modified starch.

U.S. Pat. Nos. 4,946,624; 5,112,688; and 5,126,061 disclose microcapsules prepared by a coacervation process. The microcapsules have a complex structure, with a large central core of encapsulated material, preferably a fragrance, and walls that contain small wall inclusion particles of either the core material or another material that can be activated to disrupt the wall. The microcapsules are incorporated into a fabric softener composition having a pH of about 7 or less and which further contains a cationic fabric softener. The encapsulated fragrance preferably is free of large amounts of water-soluble ingredients. The microparticles are added separately to the fabric softener compositions. Ingredients that have high and low volatilities, compared to desired fragrance, either can be added to or removed from the fragrance to achieve the desired volatility. This type of controlled release system cannot be used with all types of fragrance ingredients, in particular, with fragrance ingredients that are relatively water soluble and/or are incapable of depositing onto a fabric.

U.S. Pat. No. 4,402,856 discloses a coacervation technique to provide fragrance particles for fabric care products containing gelatin or a mixture of gelatin with gum arabic, carboxymethylcellulose, and/or anionic polymers. The gelatin is hardened with a natural and/or synthetic tanning agent and a carbonyl compound. The particles adhere to the fabric during rinse cycles, and are carried over to the dryer. Diffusion of the fragrance from the capsules occurs only in the heat-elevated conditions of a dryer.

U.S. Pat. No. 4,152,272 discloses incorporating a fragrance into wax particles to protect the fragrance during storage and through the laundry process. The fragrance/wax particles are incorporated into an aqueous fabric conditioner composition. The fragrance diffuses from the particles onto the fabric in the heat-elevated conditions of the dryer.

U.S. Pat. Nos. 4,446,032 and 4,464,271 disclose liquid or solid fabric softener compositions comprising microencapsulated fragrance suspensions. The compositions contain sustained release fragrances prepared by combining nonconfined fragrance oils with encapsulated or physically entrapped fragrance oils. These combinations are designed such that the nonconfined fragrance oil is bound in a network of physically entrapped fragrance oil and suspending agent. The controlled release system comprises a mixture of (i) a nonconfined fragrance composition, (ii) one or more fragrance oils which are physically entrapped in one or more types of solid particles, and (iii) a suspending agent such as hydroxypropyl cellulose, silica, xanthan gum, ethyl cellulose, or combinations thereof. The nonconfined fragrance, the entrapped fragrance, and the suspending agent are premixed prior to preparation of the liquid or solid fabric softener compositions.

U.S. Pat. Nos. 4,973,422 and 5,137,646 disclose fragrance particles for use in cleaning and conditioning compositions. The particles comprise a fragrance dispersed within a wax material. The particles further can be coated with a material that renders the particles more substantive to the surface being treated, for example, a fabric in a laundry process. Such materials help deliver the particles to the fabric and maximize fragrance release directly on the fabric. In general, the coating materials are water-insoluble cationic materials.

U.S. Pat. No. 6,024,943 discloses particles containing absorbed liquids and methods of making the particles. A fragrance is absorbed within organic polymer particles, which further have a polymer at their exterior. The external polymer has free hydroxyl groups, which promote deposition of the particles from a wash or rinse liquor. The external polymer can be a component of an encapsulating shell, but typically is used as a stabilizer during polymerization of the particles. A highly hydrolyzed polyvinyl alcohol is a preferred external polymer.

U.S. Pat. No. 6,740,631 discloses a free-flowing powder formed from solid hydrophobic, positively-charged nanospheres containing an active ingredient, such as a fragrance, encapsulated in a moisture sensitive microsphere. To maximize deposition of the nanospheres on a fabric, particle size is optimized to ensure entrainment of the particles within the fabric fibers, and a sufficiently high cationic charge density on the particle surface is provided to maximize an ionic interaction between the particles and the fabric.

U.S. Pat. Application No. 2003/0166490 discloses solid spheres comprising a crystallized waxy material. The waxy material may have a fragrance or other active agent incorporated therein, together with a cationic, hydrophobic charge-enhancing agent and a cationic softening agent. The spheres adhere to a fabric because of the cationic charge, and when ironing a dried fabric, a burst of fragrance occurs. The load of fragrance or other active agent is limited to about 30%, by weight, of the waxy material.

U.S. Pat. Application No. 2006/0014655 discloses the delivery of a benefit agent that is introduced into a formulation after admixture with a carrier. The agent and carrier composition requires a viscosity of at least 400 cps.

Delivery systems often are used in personal care and pharmaceutical topical formulations to extend release of the active ingredient, to protect the active ingredient from decomposition in the formulation, and/or to enable formulation of the active ingredient into the compositions due to difficulties, such as solubility or formulation esthetics. However, a need remains in the art for an efficient, controlled delivery system to effectively deposit active ingredients, such as fragrances, onto a fabric. One type of delivery system that can achieve these attributes in a formulated product is the adsorbent microparticle delivery systems.

SUMMARY OF THE INVENTION

The present invention solves a long-standing need for a simple, effective, storage-stable fragrance delivery system that provides consumer-acceptable odor benefits during and after the laundering process, and which has an acceptable product odor after storage. In particular, fabrics treated with a present fabric softener composition have an acceptable fragrance level and maintain an acceptable scent for extended periods of time after laundering and drying.

In particular, the present invention is directed to the use of a microparticle delivery system to enhance deposition of a fragrance on a fabric and to extend delivery of the fragrance from a fabric treated with a fabric softener composition. In accordance with the present invention, a fragrance is loaded onto a microparticle delivery system and the fragrance-loaded delivery system is incorporated into a fabric softener composition.

The use of a present fabric softener composition to treat a fabric extends fragrance life on the fabric compared to adding the fragrance alone to the fabric softener composition. Furthermore, a surge of fragrance can be generated, after a fabric is cleaned, softened, and dried, when the fabric is ironed.

In addition, other active ingredients can be incorporated into a fabric softener composition using the microparticle delivery system described herein. These ingredients include, but are not limited to, ironing aides, silicone fluids, anti-wrinkle agents, antistatic agents, optical brighteners, fabric crisping agents, bleaching agents, germicides, fungicides, flow agents, surfactants, and mixtures thereof. Incorporation of such active ingredients into a microparticle delivery system, and use of the delivery system in a fabric softener composition, enhances deposition of the active ingredient onto the softened fabric, and substantially extends the benefits provided by the active ingredient.

DETAILED DESCRIPTION OF THE PREFERRED EMBODIMENTS

Fabric softeners are common products used in the laundering process. A fabric softener can be added as a liquid at the end of the laundering process, i.e., in the final rinse step, or can be added during drying of the laundered fabric in the form of a sheet material having a fabric softener adhered to or imbedded in fibers comprising the sheet material. In either case, the fabric softener, because of its cationic nature, interacts with and binds to the fabric. As a result, the laundered fabric has a softer feel and an improved appearance.

A fabric softener composition, either a liquid or sheet material, contains a cationic material having a long alkyl chain, e.g., a quaternary fatty amine. Monoalkyl quaternary compounds have been used in liquid detergent softener antistatic formulations, and dialkyldimethyl quaternary compounds have been used in rinse cycle softening and as dryer softeners. Quaternary fatty amines are well-known commercial products, available from numerous companies such as Akzo Chemicals Inc. (ARQUAD); Stepan Co. (ACCOSOFT); Henkel Corporation (ALIQUAT); Humko Chemical (Witco Corporation, KEMAMINE Q); Jetco Chemicals (The Procter & Gamble Company, JET QUAT); Jordan Chemical Company (PPG Industries, JORDAQUAT and specialty quaternaries); Lonza (BARQUAT and other quaternaries); Sherex (ADOGEN); and Tomah Products (Exxon Chemical Company, TOMAH Q).

Rinse cycle softeners typically are aqueous dispersions of quaternary ammonium compounds designed to be added to the wash load during the last rinse cycle. Such fabric softener products contain about 3% to about 30%, by weight, of a quaternary ammonium compound, such as di(hydrogenated tallow)alkyl dimethylammonium chloride (DHTDMAC). Although DHTDMAC is a widely employed fabric softener, the use of imidazoline and amidoamine quaternaries, e.g., a tallow quaternary imidazoline, has increased because these compounds are easier to formulate into high active compositions.

Tumble dryer softening sheets contain a quaternary ammonium compound formulation applied to a nonwoven sheet, typically a polyester or rayon sheet. These sheets are added to the tumble dryer with the wet fabrics, and impart softening to the fabric during the drying cycle and during wear. A nonionic surfactant typically is present in a fabric softener product in combination with the quaternary ammonium compound. The nonionic surfactant acts as a release agent or distribution agent, and provides a more efficient transfer of the quaternary ammonium compound from the substrate to the drying fabric.

In addition to a quaternized fabric softener compound, a fabric softener composition, either liquid or sheet material, typically contains additional ingredients to enhance performance of the composition. For example, the fabric softener composition can contain an optical brightener to impart a whiter, brighter appearance to the laundered and dried fabric. Another important ingredient, as discussed above, is a fragrance, which enhances the esthetics of the fabric care product itself and imparts a perception of freshness and cleanliness to the laundered and dried fabric.

As also discussed above, it has long been a problem (a) to incorporate a sufficient amount of fragrance into a fabric softener composition to provide the desired composition esthetics, while simultaneously having a sufficient amount of fragrance in the composition to impart a desired fragrance to softened fabric, (b) to retain the fragrance on the laundered and dried fabric (e.g., avoid rinsing or evaporation of the fragrance from the fabric), and (c) to provide an extended fragrance release from the laundered, softened, and dried fabric.

The present invention overcomes these problems by incorporating a high percentage of a fragrance into a polymeric microparticle delivery system, then including the fragrance-loaded microparticles in a fabric softener product, either a liquid or a sheet material. Surprisingly, the fragrance-loaded microparticles adhere to the fabric, even during rinsing and drying cycles, and permit a sustained and extended release of the fragrance from the microparticles on the fabric for an extended time. As an additional benefit, consumers perceive a fragrance surge when the dried fabric is ironed because of an accelerated release of the fragrance at elevated ironing temperatures.

Adsorbent polymeric microparticles useful in the present invention have an ability to adsorb several times their weight of a solid or liquid compound, such as an active agent of the present invention. One preferred class of adsorbent polymers is prepared by a suspension polymerization technique, as set forth in U.S. Pat. Nos. 5,677,407; 5,712,358; 5,777,054; 5,830,967; 5,834,577; 5,955,552; and 6,107,429, each incorporated herein by reference (available commercially under the tradename of POLY-PORE® E200, INCI name: allyl-methacrylate crosspolymer, from AMCOL International, Arlington Heights, Ill.). Another preferred class of adsorbent polymers is prepared by a precipitation polymerization technique, as set forth in U.S. Pat. Nos. 5,830,960; 5,837,790; 6,248,849; and 6,387,995, each incorporated herein by reference (available commercially under the tradename POLY-PORE® L200 from AMCOL International, Arlington Heights, Ill.). These adsorbent polymers also can be modified after incorporation of an active ingredient to modify the rate of release of the active ingredient, as set forth in U.S. Pat. No. 6,491,953, incorporated herein by reference.

Another useful class of adsorbent polymers prepared by a precipitation polymerization technique is disclosed in U.S. Pat. Nos. 4,962,170; 4,948,818; and 4,962,133, each incorporated herein by reference, and are commercially available under the tradename POLYTRAP from AMCOL International. Other useful, commercially available adsorbent polymers include, for example, MICROSPONGE® (a copolymer of methyl methacrylate and ethylene glycol dimethacrylate), available from Cardinal Health, Sommerset, N.J., and Poly-HIPE polymers (e.g., a copolymer of 2-ethylhexyl acrylate, styrene, and divinylbenzene) available from Biopore Corporation, Mountain View, Calif.

In particular, the adsorbent polymer microparticles prepared by the suspension polymerization technique, e.g., POLY-PORE® E200, are a highly porous and highly crosslinked polymer in the form of open (i.e., broken) spheres and sphere sections characterized by a mean unit particle size of about 0.5 to about 3,000 microns, preferably about 0.5 to about 300 microns, more preferably about 0.5 to about 100 microns, and most preferably about 0.5 to about 80 microns. A significant portion of the spheres is about 20 microns in diameter.

The polymeric microparticles are oil and water adsorbent, and have an extremely low bulk density of about 0.008 gm/cc to about 0.1 gm/cc, preferably about 0.009 gm/cc to about 0.07 gm/cc, and more preferably about 0.0095 gm/cc to about 0.04-0.05 gm/cc. The microparticles are capable of holding and releasing oleophilic (i.e., oil soluble or dispersible), as well as hydrophilic (i.e., water soluble or dispersible), active agents, individually, or both oleophilic and hydrophilic compounds simultaneously.

The adsorbent polymer microparticles prepared by the suspension polymerization technique include at least two polyunsaturated monomers, preferably allyl methacrylate and an ethylene glycol dimethacrylate, and, optionally, monounsaturated monomers. The microparticles are characterized by being open to their interior, due either to particle fracture upon removal of a porogen after polymerization or to subsequent milling. The microparticles have a mean unit diameter of less than about 50 microns, preferably less than about 25 microns, and have a total adsorption capacity for organic liquids, e.g., mineral oil, that is at least about 72% by weight, preferably at least about 93% by weight, and an adsorption capacity for hydrophilic compounds and aqueous solutions of about 70% to about 89% by weight, preferably about 75% to about 89% by weight, calculated as weight of material adsorbed divided by total weight of material adsorbed plus dry weight of polymer. In a preferred embodiment, the broken sphere microparticles are characterized by a mean unit diameter of about 1 to about 50 microns, more preferably of about 1 to about 25 microns, most preferably, of about 1 to about 20 microns.

Preferred polymeric microparticle delivery systems comprise a copolymer of allyl methacrylate and ethylene glycol dimethacrylate, a copolymer of ethylene glycol dimethacrylate and lauryl methacrylate, a copolymer of methyl methacrylate and ethylene glycol dimethacrylate, a copolymer of 2-ethylhexyl acrylate, styrene, and divinylbenzene, and mixtures thereof.

Specific polymeric microparticles useful in the present invention can be the previously described POLY-PORE® E200, POLY-PORE® L200, POLYTRAP, MICROSPONGE, or Poly-HIPE particles, for example. A fragrance is loaded onto such microparticles to provide microparticles containing about 10% to about 90%, by weight, of a fragrance. The fragrance-loaded microparticles typically are incorporated into a fabric softener composition in an amount to provide about 0.05% to about 8%, by weight, of a fragrance in the composition.

To function as a delivery system for an active ingredient (e.g., a fragrance), the active ingredient first is loaded onto the microparticles. Loading of the active ingredient onto the microparticles also is referred to herein as an "entrapment." The term entrapment refers to a physical loading of the active ingredient onto the microparticles.

Loading can be accomplished by spraying or adding the active ingredient directly to the microparticles in a manner such that an essentially homogeneous distribution of the active ingredient on the microparticles is achieved. This is especially effective for fragrance oils. After loading the fragrance oil on the microparticles, a barrier layer (i.e., a secondary entrapment), optionally, can be applied to the loaded microparticles to prevent rapid diffusion of the fragrance, or other active ingredient, from the microparticles, and to protect the ingredient from an elevated temperature attained during drying. Also, the melting point of the barrier layer can be selected such that it melts during ironing of the treated fabric and allows a surge release of the fragrance, or other active ingredient (e.g., an ironing aid), during ironing of the fabric.

Examples of materials that can be used as a barrier layer include, but are not limited to, $C_8$-$C_{20}$ alcohols and fatty alcohols ethoxylated with one to three moles of ethylene oxide. Nonlimiting examples of fatty alcohols and ethoxylated fatty alcohols include, but are not limited to, behenyl alcohol, caprylic alcohol, cetyl alcohol, cetaryl alcohol, decyl alcohol, lauryl alcohol, isocetyl alcohol, myristyl alcohol, oleyl alcohol, stearyl alcohol, tallow alcohol, steareth-2, ceteth-1, cetearth-3, and laureth-2. Additional fatty alcohols and alkoxylated alcohols are listed in the International Cosmetic Ingredient Dictionary and Handbook, Tenth Edition, Volume 3, pages 2127 and pages 2067-2073 (2004), (hereafter International Cosmetic Dictionary) incorporated herein by reference.

Another class of materials that can be used a barrier layer is the $C_8$-$C_{20}$ fatty acids, including, but not limited to, stearic acid, capric acid, behenic acid, caprylic acid, lauric acid, myristic acid, tallow acid, oleic acid, palmitic acid, isostearic acid and additional fatty acids listed in the International Cosmetic Dictionary, page 2126-2127, incorporated herein by reference. The barrier material also can be a hydrocarbon, like mineral oil, 1-decene dimer, polydecene, paraffin, petrolatum, vegetable-derived petrolatum or isoparaffin. Another class of barrier materials is waxes, both natural and synthetic, like mink wax, carnauba wax, candelilla wax, silicone wax, polyethylene, and polypropylene, for example.

Fats and oils also can be used as barrier layer materials, including, for example, but not limited to, lanolin oil, linseed oil, coconut oil, olive oil, menhaden oil, castor oil, soybean oil, tall oil, rapeseed oil, palm oil, and neatsfoot oil, and additional fats and oils listed in the International Cosmetic Dictionary, pages 2124-2126. Other useful classes of barrier materials include a water-insoluble ester having at least 10 carbon atoms, and preferably 10 to about 32 carbon atoms. Numerous esters are listed in International Cosmetic Dictionary, pages 2115-2123.

Alternatively, an active ingredient can be admixed with a molten waxy material, then loaded into a microparticle delivery system. The waxy materials disclosed above as the barrier materials also can be used as an additive for thickening the active ingredient and thereby helping to minimize premature diffusion of the active ingredient from the polymeric microparticles.

A fabric softener composition of the present invention therefore comprises a cationic fabric softener and a delivery system comprising polymeric microparticles loaded with an active ingredient and an optional barrier material. The fabric softener composition also can contain optional ingredients well known in the fabric softener art, for example, one or more of a dye, a pH adjusting agent, a solvent, and similar adjuvants.

The active ingredient incorporated into the polymeric microparticles preferably comprises a fragrance. The fragrance can be a single compound, but typically is a complex mixture of organic chemicals. Other active ingredients that can be loaded onto the polymeric microparticles include, but are not limited to, an ironing aide, a silicone fluid, an anti-wrinkle agent, an antistatic agent, an optical brightener, a fabric crisping agent, a bleaching agent, a germicide, a fungicide, a flow agent, a surfactant, or mixtures thereof.

The active ingredient is loaded into the polymeric microparticles in an amount to provide microparticles containing about 10% to about 90%, preferably about 35% to about 85%, and more preferably about 50% to about 80%, by weight of the loaded microparticles. As used herein, the term "loaded microparticle" refers to a microparticle having an active ingredient added thereto. Loading of the active ingredient includes one or more of impregnating, imbedding, entrapping, absorbing, and adsorbing of the active ingredient into or onto the polymeric microparticles.

When a barrier layer is applied to a loaded microparticle, the barrier layer comprises about 1% to about 50%, and preferably about 5% to about 45%, by weight, of the loaded microparticle. To achieve the full advantage of the present invention, the barrier layer is present at about 15% to about 40%, by weight, of the loaded microparticle.

The loaded microparticles are included in a fabric softener composition. As stated above, the fabric softener composition comprises about 3% to about 30%, by weight, of a cationic fabric softener. The loaded microparticles are included in the fabric softener composition in a sufficient amount to provide about 0.05% to about 8%, and preferably about 0.1% to about 5% of the active ingredient, by weight of the fabric softener composition.

The identity of the cationic fabric softener is not limited, as long as the fabric softener effectively softens fabrics. The cationic fabric softener can be a quaternary fatty amine, a quaternized imidazoline, a quaternized amidoamine, and mixtures thereof, for example. In each case, the cationic fabric softener contains at least one long chain (e.g., $C_8$-$C_{20}$) alkyl group.

Nonlimiting examples of useful cationic fabric softeners include, but are not limited to, di(hydrogenated tallow)alkyl dimethylammonium chloride, a tallow quaternary imidazoline, methyl bis-(hydrogenated tallow amidoethyl)-2-hydroxyethyl ammonium methyl sulfate, methyl bis(tallowamido ethyl)-2-hydroxyethyl ammonium methyl sulfate, methyl bis(soya amidoethyl)-2-hydroxyethyl ammonium sulfate, methyl bis(canola amidoethyl)-2-hydroxyethyl ammonium methyl sulfate, methyl bis(tallowamido ethyl)-2-tallow imidazolinum methyl sulfate, methyl bis(ethyl tallowate)-2-hydroxyethyl ammonium methyl sulfate, N,N-di (beta-stearoylethyl)-N,N-di-methyl ammonium chloride, dihydrogenated tallow diamidoammonium methosulfate, di(tallow)diamidoammonium methosulfate, di(modified) tallow diamidoammonium methosulfate, disoya diamidoammonium methosulfate, ditallow imidazolinium methosulfate, dehydrogenated tallow imidazolinium methosulfate, dimethyl dihydrogenated tallow ammonium chloride, dimethyldialkyl ammonium chloride, dimethylditallow alkyl quaternary ammonium chloride, alkylamidoethyl alkyl imidazolinium methyl methosulfate, modified alkylaminoethyl alkyl imidazolinium methyl methosulfate, distearyl dimonium chloride, methyl bis-(hydrogenated tallow amido ethyl) 2-hydroxyethyl ammonium chloride, PEG-15 tallow polyamines, N-alkyl-N,N-dimethyl-N-(dodecyl acetate)ammonium, chloride, cocamidopropyl ethyl dimonium ethosulfate, N-(3-isostearyl-amidopropyl)-N,N-dimethyl-N-ethyl ammonium sulfate, stearamidopropyl ethyl-dimonium ethosulfate, isostearyl amido betaine, fatty imidazoline 1-hydroxyethyl 2-heptadecyl imidazoline, methyl bis-(hydrogenated tallow amidoethyl) 2-hydroxyethyl ammonium methylsulfate, dimethyl di-(hydrogenated tallow) ammonium methyl sulfate, methyl-1-tallowamidoethyl-2-tallow imidazolinium methyl sulfate, tallow-bishydroxy-ethyl-methyl ammonium chloride, methyl(1)oleyl amido ethyl(2)-oleyl imidazolinium methyl sulfate, and mixtures thereof. A fabric softener compound can be used alone, or in admixture with one or more additional fabric softener compounds.

Commercially available fabric softeners include, but are not limited to, ACCOSOFT® 440-75, 440-75 DEG, 540, 540 HC, 550 HC, 550 HFC, 550 L-90, 550-90 HF, 550-90 HHV, 580, 580 HC, 620-90, 750, 808, 808 HT, 808-90, and 870 (Stepan Co.); ADOGEN 432 and 442 (Sherex Chemical Co., Inc.); AHCOVEL® Base, Base N-62, Base 500, Base 700, N-15, and OB (ICI Americas Inc.); ALUBRASOFT Super 100 and 77N (PPG Industries); ARMOSOF DA6B, 101, 102, 104, and DA3 (Akzo Chemicals Inc.); ARQUAD 2HT-75 and 2T-75 (Akzo Chemicals Inc.); AVITEX ML and AVITONE A (E.I. duPont de Nemours and Co.); BARRE® Common Degras (R.I.T.A. Corp.); CARSOSOFT® S-90, S-90M, and T-90 (Lonza Inc.); CERANINE HCA, PN Chunks, and Chemical Base 39 (Sandoz Chemicals Corp.); CIRRASOL® G-1536 and G-1564 (ICI Americas Inc.); DEHYQUART DAM (Henkel Canada Ltd.); DILOSOF RW (Sandoz Chemicals Corp.); DOUSOFT BK 5078 (Clough Chemical Inc.); Dow Corning 929 Cationic Emulsion (Dow Corning Corp.); EMKALON CL and CNW (Emkay Chemical Co.); HYSOF DLC Conc. and 975 (Rhone-Poulenc); INCROSOFT CFI-75, S-75, S-90, T-90, and 100 (Croda Inc.); MASIL EM253 Emulsion and EM 401A Emulsion (PPG Industries); PLION LFS, NP, and S-100 (Vikon Chemical Co.); POLYQUART H (Henkel Canada Ltd.); Ross Soft 02-152-01 (Ross Chem., Inc.); SCHECOQUAT ALA, CAS, IAS, and SAS and SCHECOTAINE IAB (Scher Chemicals, Inc.); SM-2112 (General Electric Co.); UNAMINE®-S (Lonza Inc.); VARISOFT 110, 137, 222, 222 LM 90%, 222 LT 90%, 238, 475, 920, and 3690 (Sherex Chemical Co.); and VELVAMINE 109 (Rhone-Poulenc).

The fabric softener composition is aqueous, but also can contain a solvent, such as an alcohol, to facilitate manufacture of the composition, to improve esthetics, or to improve efficacy of the composition.

EXAMPLES

Example 1

Loading of a Citrus Mix Fragrance

To POLYTRAP 6603 microparticles (75 g) was added 300 g of citrus mix fragrance (available from Fragrance Oils Ltd., Radcliffe, Manchester, UK). The microparticles and the fragrance were admixed until the fragrance was homogeneously dispersed throughout the microparticles. The final product was a free flowing powder-like material.

An identical loading was performed, except that the POLYTRAP 6603 microparticles were replaced by POLY-PORE® E200 microparticles.

Example 2

Loading of Lavender and Softly Fragrances

Similar loadings as described above in Example 1 were repeated both for a lavender fragrance and a fragrance termed "Softly" (both from Fragrance Oils Ltd.). For each fragrance, both the POLYTRAP and POLY-PORE® microparticle delivery systems were used.

Example 3

Loading of Dimethicone

To POLYTRAP® 6603 (100 g) was added 400 g of dimethicone (350 centistoke (cSt)). The microparticles and dimethicone then were admixed until a uniform mixture was provided. The same loading also was performed using dimethicone polymers of different molecular weights (i.e., 20, 100, and 10,000 cSt).

Example 4

Loading of an Optical Brightener

To POLYTRAP® 6603 (75 g) was added 150 g of a commercial optical brightener dispersion (TINOPAL DMS Slurry 36 from Ciba Specialty Chemicals), then the two materials were admixed until a uniform mixture of the materials provided a free-flowing powder. In another sample, 225 g of the optical brightener dispersion was added to 75 g of POLYTRAP® 6603, which again provided a free-flowing powder.

Example 5

Loading of a Fragrance with a Secondary Entrapment

To POLYTRAP® 6603 (40 g) was added 80 g of a lavender fragrance, described in Example 2 above. Shea butter (Fanning Corporation, 80 g) was melted in an oven at 60° C., then the molten Shea butter was added to the loaded fragrance. The resulting product was a free flowing white powder having a final composition of POLYTRAP® 6603 20%, fragrance 40%, and Shea butter 40%, by weight. Two other loadings were prepared using the same procedure to provide a final composition containing (a) POLYTRAP® 6603 20%, fragrance 50%, and Shea butter 30%, and (b) POLYTRAP® 6603 20%, fragrance 60%, and Shea butter 20%, by weight.

Example 6

Test Methods

Test swatches were washed in the absence of a detergent. The fabric softener was added after the washing cycle, and therefore was the sole source of fragrance in this test.

Ten 100% cotton towels having dimensions 15 inches by 16 inches were used for evaluating the performance of the fragrance-loaded material of the present invention. The fabric was laundered using a Miele Novotronic W864 series washing machine.

Wash Conditions:
Fabric Load: 10 towels
Laundry detergent sample size: none
Fabric softener sample size: 100 grams, including 3%, by weight, fragrance loaded microparticles.
Dosing: Fabric softener was placed in the dispenser.
Water level: normal load
Water temperature: 40° C.
Cycle: short
Rinse: one rinse cycle
Speed: heavy duty 1200 RPM The laundered fabric was line dried overnight in a fragrance-free room. The dry fabric was folded into individual drawers of filing cabinets approximately 25 cm (centimeters) deep, 25 cm wide, and 40 cm in length, which were closed until the sniff test. The sniff test was performed on the laundered fabric by five evaluators, both in the wet state and 24 hours after drying of the towels. The individual drawers were closed, and the sniff test was repeated at given intervals. According to the procedure, the samples were provided to a panel of five odor specialists who independently ranked odor intensity of the dry laundered fabric using a scale of 0 (no perceived odor) to 10 (high odor intensity). Samples yielding an odor ranking below about 2 have an odor that is barely perceived by the general public.

Example 7

Fragrance Retention

The performance of a fabric conditioner product comprising the fragrance delivery system of Example 1 was evaluated and compared to the performance of the same fabric conditioner comprising the neat fragrance, at the same fragrance level. The liquid fabric conditioner base was commercially available fragrance-free SURCARE fabric conditioner available from Mc Bride, UK. Performance was measured as an ability to increase fragrance deposition onto fabric, as well as an ability to prolong fragrance release from the dry laundered fabric over an extended period of time, or to yield a high impact fragrance surge when ironing the fabric.

Samples were prepared at a 2.4%, by weight, effective fragrance concentration using the fragrance-loaded microparticles described in Example 1. The control sample was prepared by weighing 2.4 gram of the neat fragrance and 97.6 grams of the SURCARE into a jar, followed by mixing for about five minutes. A fabric softener composition comprising fragrance-loaded microparticles was prepared by weighing 3 grams of the fragrance-loaded particles of Example 1 and 97 grams of the SURCARE unfragranced liquid fabric conditioner base into a jar. The resulting mixture was mixed for about 5 minutes.

Cloth samples were washed as described in the test method and line dried for 24 hours. Evaluations were made as follows: immediately after washing (in wet stage); after drying (24 hours following wash); and after storage in cabinet drawers for 5, 10, 15, 20, 25, and 30 days.

Test results are summarized below:

Test results (odor intensity versus time) indicate that the cloth samples washed with the loaded fragrances of Example 1 have a significantly more intense fragrance than the control samples washed with the neat fragrance immediately after drying (24 hours following wash).

TABLE 1

| Citrus mix fragrance | | | | | | |
|---|---|---|---|---|---|---|
| Sample | Day 0 (wet) | Day 1 | Day 5 | Day 10 | Day 20 | Day 30 |
| Neat fragrance | 8 | 2 | 0 | 0 | 0 | 0 |
| Fragrance loaded in delivery system | 8 | 8 | 7 | 5 | 3 | 0 |

TABLE 2

| Lavender fragrance | | | | | | |
|---|---|---|---|---|---|---|
| Sample | Day 0 (wet) | Day 1 | Day 5 | Day 10 | Day 20 | Day 30 |
| Neat fragrance | 7 | 2 | 0 | 0 | 0 | 0 |
| Fragrance loaded in delivery system | 7 | 7 | 6 | 4 | 2 | 0 |

TABLE 3

| Softly fragrance | | | | | | |
|---|---|---|---|---|---|---|
| Sample | Day 0 (wet) | Day 1 | Day 5 | Day 10 | Day 20 | Day 30 |
| Neat fragrance | 6 | 2 | 0 | 0 | 0 | 0 |
| Fragrance loaded in delivery system | 6 | 6 | 5 | 4 | 2 | 0 |

After 5, 10, and 20 days, the test results indicate that the cloth samples washed with the loaded fragrances of Example 1 have a significantly more intense fragrance than the control samples washed with the neat fragrance (control). The products comprising the loaded fragrance show significant improvement over the performance of the neat fragrance in sustaining the volatile constituents of the fragrance and providing a prolonged fragrance release from the dry laundered fabric over an extended period of time.

Example 8

Citrus Fragrance "Burst" During Ironing

Performance during ironing of a fabric treated with a fabric conditioner comprising the citrus fragrance delivery system of Example 1 was evaluated, and compared to the performance during ironing of a fabric treated with the same fabric conditioner but comprising a neat citrus fragrance at the same fragrance level of Example 4. Performance was measure as a noticeably intense fragrance burst when ironing the fabric.

Cloth samples were washed as described in the test method and line dried for 24 hours. Evaluations were made comparing the effect of ironing the fabric washed in the 3% loaded citrus fragrance to the 2.4% neat citrus fragrance, with the temperature of the iron set to the "cottons" temperature setting. The score for intensity was judged independently on a scale of 10.

Test results are summarized below:

| Neat fragrance "burst" intensity | Encapsulated fragrance "burst" intensity |
|---|---|
| 3 | 9 |

These results indicate that a cloth sample washed with the loaded citrus fragrance has a significantly more intense fragrance "burst" during ironing, which indicates that a present delivery system breaks down under heat and/or pressure, which in turn leads to a concentrated release of the fragrance.

Example 9

Stability in Formulation

The stability of both the loaded and neat fragrance was judged by introducing the same quantity of fragrance into the commercial fabric softener described in Example 4. For this example, only the loading of the lavender fragrance was used. For both samples, either the neat or the loaded fragrance was added into the commercial fabric softener, mixed until uniform, and then sealed containers of the modified fabric softener were placed in an oven at 40° C. to simulate accelerated aging of the samples. The intensity of the fragrance after washing was investigated as described above in Example 4 at set periods of time. The results are tabulated in Tables 4 and 5, below.

TABLE 4

| Sample | Days Aging (40° C.) | Day 0 | Day 1 | Day 2 |
|---|---|---|---|---|
| Lavender-neat | 0 | 7 | 1 | 0 |
| | 12 | 4 | 1 | 0 |
| | 30 | 2 | 0.5 | 0 |
| | 60 | 2 | 0.5 | 0 |
| | 80 | 1 | 0 | 0 |

TABLE 5

| Sample | Days Aging (40° C.) | Fragrance Intensity Day 0 | Day 5 | Day 10 | Day 15 | Day 20 | Day 30 |
|---|---|---|---|---|---|---|---|
| Lavender--Entrapped | 0 | 7 | 6 | 4 | 3 | 2 | 0 |
| | 12 | 6 | 5 | 3 | 2 | 1 | 0 |
| | 30 | 5 | 4 | 2.5 | 1.5 | 0 | 0 |
| | 60 | 4 | 3 | 2 | 1 | 0 | 0 |
| | 80 | 3 | 2 | 1 | 0 | 0 | 0 |

The data in Table 4, as in Example 4, shows that the neat lavender fragrance loses intensity after only a day storage of the dried towels. Furthermore, the effect of aging at 40° C. further decreases the duration of the fragrance. Loading the fragrance in a microparticle delivery system not only improves the initial fragrance retention, as previously shown, but also extends the fragrance effect even when the formulation is subjected to accelerated aging. For example, after 80 days of aging at 40° C., the fragrance still is observed after 10 days of storing the towels under ambient conditions. In contrast, the neat fragrance only showed minimal fragrance intensity immediately after drying the towels.

Example 10

Loading of Dimethicone into a Fabric Softener

Ten 100% cotton towels having dimensions 15 inches by 16 inches were used for evaluating the performance of the dimethicone-loaded material of the present invention. The fabric was laundered using a Miele Novotronic W864 series washing machine.

Wash Conditions:

Fabric Load: 10 towels

Laundry detergent sample size: none

Fabric softener sample size: 100 grams, including 3%, by weight, dimethicone-loaded microparticles in matrix formulated as follows; 3 g nonionic surfactant (LUTENSOL GD 70, BASF Corp.), 0.5 g CMC, 0.167 g silicone antifoamer, 97 ml water.

Dosing: Fabric softener was placed in the dispenser.

Water level: normal load

Water temperature: 40° C.

Cycle: short

Rinse: one rinse cycle

Speed: heavy duty 1200 RPM

Control Fabric: 10 towels washed as above with only 100 g of formulation described above.

The laundered fabric was line dried overnight in the same atmosphere. The dry fabric was folded into separate piles and put into a drawer of a filing cabinet approximately 25 cm (centimeters) deep, 25 cm wide, and 40 cm in length, which were closed for the three different washed fabrics to allow moisture contents to normalize for 24 hours until the softness scoring test.

Softness testing was performed by a panel of five specialists who compared the towels washed in the 3% loaded dimethicone formulation to the towels washed in the formulation alone 24 hrs after placing the towels in the drawer. The scoring system was performed by testing the towels in duplicate with a score of +2 for a much softer feel compared to the standard formulation, +1 for slightly softer, 0 for no difference, −1 for slightly worse, and −2 for much worse.

The test results summarized below indicate that the cloth samples washed with the loaded dimethicone of Example 6 feel significantly softer than the control samples washed with the formulation alone.

| Panelist | Formulation only (set at score 0) | Formulation with dimethicone (100 cst) | Formulation with dimethicone (1000 cst) |
|---|---|---|---|
| 1 | 0 | +2 | +2 |
| 2 | 0 | +1 | +1 |
| 3 | 0 | +1 | +1 |
| 4 | 0 | +1 | +2 |
| 5 | 0 | 0 | +1 |

Obviously, many modifications and variations of the invention as hereinbefore set forth can be made without departing from the spirit and scope thereof and, therefore, only such limitations should be imposed as are indicated by the appended claims.

What is claimed is:

1. A fabric softener composition comprising a cationic fabric softener and a fragrance delivery system comprising (a) a fragrance loaded onto polymeric microparticles comprising a copolymer of ethylene glycol dimethacrylate and lauryl methacrylate and (b) a barrier layer.

2. The fabric softener composition of claim 1 wherein the fragrance delivery system comprises about 10% to 90%, by weight, of the fragrance.

3. The fabric softener composition of claim 1 wherein the fragrance delivery system comprises about 35% to 85%, by weight, of the fragrance.

4. The fabric softener composition of claim 1 wherein the fragrance delivery system comprises about 50% to 80%, by weight, of the fragrance.

5. The fabric softener composition of claim 1 wherein the fragrance is present in the composition in an amount of about 0.05% to about 8%, by weight.

6. The fabric softener composition of claim 1 wherein the fragrance is present in the composition in an amount of about 0.1% to about 5%, by weight.

7. The fabric softener composition of claim 1 wherein the barrier layer is present in an amount of about 1% to about 50%, by weight of the fragrance delivery system.

8. The fabric softener composition of claim 7 wherein the barrier layer is present in an amount of about 5% to about 45%, by weight of the fragrance delivery system.

9. The fabric softener composition of claim 8 wherein the barrier layer is present in an amount of about 15% to about 40%, by weight of the fragrance delivery system.

10. The fabric softener composition of claim 1 wherein the composition is a liquid.

11. The fabric softener composition of claim 1 wherein the composition is incorporated into a sheet material.

12. A method of imparting a fragrance to a fabric comprising (a) providing a fabric wetted with water;

(b) contacting a composition of claim 1 with the wetted fabric of step (a); and (c) drying the fabric resulting from step (b).

13. The method of claim 12 wherein the composition of claim 1 is a liquid.

14. The method of claim 12 wherein the composition of claim 1 is incorporated into a sheet material prior to contacting the wetted fabric.

15. The method of claim 12 wherein the dried fabric of step (c) has a perceptible fragrance attributable to a composition of claim 1 twenty days after contacting the wetted fabric with the composition of claim 1.

16. A fabric softener composition comprising a cationic fabric softener and a fragrance delivery system comprising a fragrance loaded onto polymeric microparticles comprising a copolymer of ethylene glycol dimethacrylate and lauryl methacrylate, wherein the composition is incorporated into a sheet material.

17. The fabric softener composition of claim 16 wherein the fragrance delivery system comprises about 10% to 90%, by weight, of the fragrance.

18. The fabric softener composition of claim 16 wherein the fragrance is present in the composition in an amount of about 0.05% to about 8%, by weight.

19. The fabric softener composition of claim 16 wherein the fragrance delivery system further comprises a barrier layer.

20. The fabric softener composition of claim 19 wherein the barrier layer is present in an amount of about 1% to about 50%, by weight of the fragrance delivery system.

21. A method of imparting a fragrance to a fabric comprising (a) providing a fabric wetted with water;

(b) contacting a sheet material of claim 16 with the wetted fabric of step (a); and (c) drying the fabric resulting from step (b).

22. The method of claim 21 wherein the dried fabric of step (c) has a perceptible fragrance attributable to a composition of claim 16 twenty days after contacting the wetted fabric with the sheet material of claim 16.

* * * * *